US008354983B2

(12) United States Patent
Lin et al.

(10) Patent No.: US 8,354,983 B2
(45) Date of Patent: Jan. 15, 2013

(54) DISPLAY AND COMPENSATION CIRCUIT THEREFOR

(75) Inventors: Chih-Lung Lin, Tainan County (TW); Kuan-Wen Chou, Kaohsiung (TW); Chun-Da Tu, Yunlin County (TW)

(73) Assignee: National Cheng Kung University, Tainan (TW)

( * ) Notice: Subject to any disclaimer, the term of this patent is extended or adjusted under 35 U.S.C. 154(b) by 426 days.

(21) Appl. No.: 12/709,295

(22) Filed: Feb. 19, 2010

(65) Prior Publication Data

US 2011/0205221 A1 Aug. 25, 2011

(51) Int. Cl.
*G09G 3/30* (2006.01)

(52) U.S. Cl. ..... 345/77; 345/76; 345/78; 345/82; 345/84; 345/89; 345/204; 345/211; 345/690; 315/169.3

(58) Field of Classification Search ..... 345/76–83, 345/213, 92, 84, 204, 211–212; 315/169.3; 349/42–49

See application file for complete search history.

(56) References Cited

U.S. PATENT DOCUMENTS

2007/0164937 A1* 7/2007 Jung et al. ..... 345/76
2008/0231558 A1* 9/2008 Naugler ..... 345/76

* cited by examiner

*Primary Examiner* — Lun-Yi Lao
*Assistant Examiner* — Md Saiful A Siddiqui

(57) ABSTRACT

A display includes a scan line, a data line, a pixel circuit, a compensation circuit, a voltage controller, and a data line driver. The data line forms a junction with the scan line. The pixel circuit is disposed at the junction of the scan line and the data line. When the scan line and the data line are driven, the pixel circuit generates a driving current. The compensation circuit generates a comparing signal and a positioning signal based on the driving current. The voltage controller generates a reference voltage that corresponds to the positioning signal with reference to the comparing signal. The data line driver corrects an image signal based on the reference voltage, and drives the data line with the corrected image signal. A compensation circuit for the display is also disclosed.

10 Claims, 13 Drawing Sheets

FIG. 12
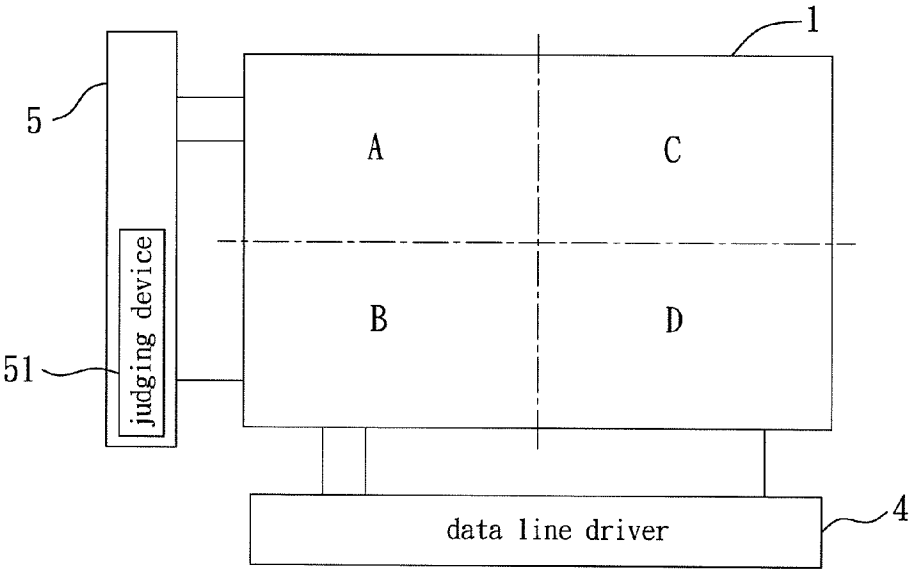
FIG. 13A
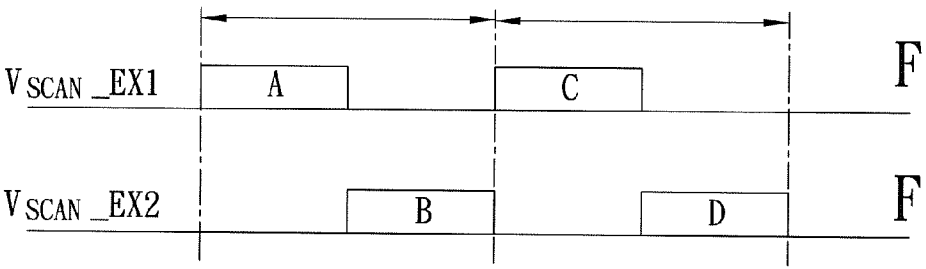
FIG. 13B

DISPLAY AND COMPENSATION CIRCUIT THEREFOR

BACKGROUND OF THE INVENTION

1. Field of the Invention

This invention relates to a display, and a compensation circuit therefor.

2. Description of the Related Art

FIG. 1 illustrates a conventional active matrix organic light-emitting diode (AMOLED) display that includes a display panel 95, a scan line driver 96, and a data line driver 97. The display panel 95 includes an array of pixel circuits 9. The pixel circuits 9 in each row are connected to a scan line 93, whereas the pixel circuits 9 in each column are connected to a data line 94. The scan line driver 96 is connected to the scan lines 93. The data line driver 97 is connected to the data lines 94. Each of the pixel circuits 9, as illustrated in FIG. 2, includes an OLED 91 and a driving member 92. The driving member 92 has a 2T1C structure, and includes first and second transistors 921, 922 and a capacitor 923.

When one of the scan lines 93 is driven by a scan voltage ($V_{SCAN}$) generated by the scan line driver 96 and one of the data lines 94 is driven by a data voltage ($V_{DATA}$) generated by the scan line driver 97, the pixel circuit 9, e.g., the pixel circuit 90, on a junction of the scan line 93 and the data line 93 is activated. That is, the first transistor 921 of the pixel circuit 90 is turned on, a capacitor voltage, which corresponds to the data voltage ($V_{DATA}$), appears across the capacitor 923 of the pixel circuit 90, the second transistor 922 of the pixel circuit 90 is biased into the saturated region by the capacitor voltage and a supply voltage (VDD) and generates a driving current, and the OLED 91 of the pixel circuit 90 is driven by the driving current to emit light. The driving current ($I_{DRIVE}$) is computed as $$I_{DRIVE} = \frac{1}{2}k_{922}(V_{C,923} - V_{TH,922})^2$$

where $k_{922}$ is a device trans-conductance parameter of the second transistor 922 of the pixel circuit 90, $V_{C,923}$ is a capacitor voltage across the capacitor 923 of the pixel circuit 90, and $V_{TH,922}$ is a threshold voltage of the second transistor 922 of the pixel circuit 90.

The aforementioned conventional AMOLED display is disadvantageous in that, since the threshold voltage of the second transistor 922 differs from one pixel circuit 9 to another due to manufacturing drift and operating conditions, the driving current generated by the second transistor 922 also differs from one pixel circuit 9 to another. As such, the intensities of light emitted by the OLEDs 91 of the pixel circuits 9 are not uniform. In order to minimize the effect of the threshold voltage on the driving current, it has been proposed to add transistors and capacitors to the driving member 92 of each of the pixel circuits 9. This, however, reduces an aperture ratio of the conventional AMOLED display.

Moreover, since the length of a line through which the supply voltage (VDD) is applied increases with the number of the pixel circuits 9, the supply voltage is severely attenuated, particularly for a large size conventional AMOLED display. This also reduces uniformity in the intensities of light emitted by the OLEDs 91 of the conventional AMOLED display.

Furthermore, a voltage across the OLED 91 of each of the pixel circuits 9 of the conventional AMOLED display increases over time. This undesirably affects current flowing through the OLED 91, and thus reduces the light-emitting efficiency of the OLED 91.

SUMMARY OF THE INVENTION

Therefore, an object of the present invention is to provide a display that can overcome the aforesaid drawbacks of the prior art.

Another object of the present invention is to provide a compensation circuit for the display.

According to an aspect of the present invention, a display comprises a scan line, a plurality of data lines, a plurality of pixel circuits, a compensation circuit, a voltage controller, and a data line driver. The data lines form junctions with the scan line. Each of the pixel circuits is disposed at a corresponding one of the junctions of the scan line and the data lines and includes a light-emitting member. When the scan line and one of the data lines are driven, the pixel circuit on the junction of the scan line and said one of the data lines is activated, and generates a driving current that drives the light-emitting member thereof to emit light. The compensation circuit is coupled to the pixel circuits, and is operable so as to generate a comparing signal and a positioning signal based on the driving current generated by an activated one of the pixel circuits. The positioning signal indicates a position of the activated one of the pixel circuits. The voltage controller is coupled to the compensation circuit, and is operable so as to generate a reference voltage that corresponds to the positioning signal with reference to the comparing signal generated by the compensation circuit. The data line driver is coupled to the data lines and the voltage controller, is adapted to receive an image signal, and is operable so as to correct the image signal received thereby based on the reference voltage generated by the voltage controller, and so as to drive the data lines with the image signal corrected thereby.

According to another aspect of the present invention, a display comprises a plurality of scan lines, a plurality of data lines, a plurality of pixel circuits, a compensation circuit, a voltage controller, and a data line driver. The data lines form junctions with each of the scan lines. Each of the pixel circuits is disposed at a corresponding one of the junctions of the scan lines and the data lines, and includes a light-emitting member. When the data lines and one of the scan lines are driven, a set of the pixel circuits on the junctions of the data lines and the one of the scan lines is activated, and generates a driving current that drives the light-emitting members thereof to emit light. The compensation circuit is coupled to the pixel circuits, and is operable so as to generate a comparing signal and a positioning signal based on the driving current generated by an activated set of the pixel circuits. The positioning signal indicates a position of the one of the scan lines. The voltage controller is coupled to the compensation circuit, and is operable so as to generate a reference voltage that corresponds to the positioning signal with reference to the comparing signal generated by the compensation circuit. The data line driver is coupled to the data lines and the voltage controller, is adapted to receive an image signal, and is operable so as to correct the image signal received thereby based on the reference voltage generated by the voltage controller, and so as to drive the data lines with the image signal corrected thereby.

According to yet another aspect of the present invention, a display comprises a plurality of scan lines, a plurality of data lines, a plurality of pixel circuits, a compensation circuit, a voltage controller, and a data line driver. The data lines form junctions with each of the scan lines. Each of the pixel circuits is disposed at a corresponding one of the junctions of the scan lines and the data lines, and includes a light-emitting member. When the scan lines and one of the data lines are driven, a set of the pixel circuits on the junctions of the scan lines and one of the data lines is activated, and generates a driving current that drives the light-emitting members thereof to emit light. The compensation circuit is coupled to the pixel circuits, and is operable so as to generate a degradation parameter and a positioning signal based on the driving current generated by an activated set of the pixel circuits. The positioning signal indicates a position of one of the data lines that corresponds to the activated set of the pixel circuits. The voltage controller is coupled to the compensation circuit, and is operable so as to generate a reference voltage that corresponds to the positioning signal with reference to the comparing signal generated by the compensation circuit. The data line driver is coupled to the data lines and the voltage controller, is adapted to receive an image signal, and is operable so as to correct the image signal received thereby based on the reference voltage generated by the voltage controller, and so as to drive the data lines with the image signal corrected thereby. The compensation circuit includes a plurality of judging devices corresponding in number to the data lines. Each of the judging devices includes a time determining unit and a degradation parameter determining unit. The time determining unit is coupled to a corresponding set of the pixel circuits that are disposed at the junctions of the data lines and a corresponding one of the scan lines, and determines a time it takes for the driving current generated by the corresponding set of the pixel circuits to reach a threshold value after the corresponding set of the pixel circuits is driven by a predetermined test signal that increases according to a predetermined rule. The degradation parameter determining unit is coupled to the time determining unit for generating the degradation parameter with reference to the predetermined test signal and the time determined by the time determining unit. The degradation parameter indicates a level of degradation of the corresponding set of the pixel circuits and serving as a basis for generation of the reference voltage by the voltage controller.

According to one more aspect of the present invention, a display comprises a plurality of scan lines, a plurality of data lines, a plurality of pixel circuits, a compensation circuit, a voltage controller, and a data line driver. The data lines form junctions with each of the scan lines. Each of the pixel circuits is disposed at a corresponding one of the junctions of the scan lines and the data lines, and includes a light-emitting member. When one of the scan lines and one of the data lines are driven, one of the pixel circuits on the junctions of said one of the scan lines and said one of the data lines is activated, and generates a driving current that drives the light-emitting member thereof to emit light. The compensation circuit is coupled to the pixel circuits, and is operable so as to generate a voltage parameter based on the driving current generated by an activated one of the pixel circuits. The voltage controller is coupled to the compensation circuit, and is operable so as to generate a reference voltage that corresponds to a position of the activated one of the pixel circuits with reference to the voltage parameter generated by the compensation circuit. The data line driver is coupled to the data lines and the voltage controller, is adapted to receive an image signal, and is operable so as to correct the image signal received thereby based on the reference voltage generated by the voltage controller, and so as to drive the data lines with the image signal corrected thereby. The compensation circuit includes a plurality of judging devices corresponding in number to the data lines. Each of the judging devices includes a current comparing unit and a lookup table. The current comparing unit is coupled to a corresponding set of the pixel circuits that are disposed at the junctions of the scan lines and a corresponding one of the data lines, and determines a difference between the driving current generated by an activated one of the pixel circuits in the corresponding set and a threshold current value after the activated one of the pixel circuits is driven by a predetermined test signal. The lookup table is coupled to the current comparing unit for locating the voltage parameter with reference to the difference determined by the current comparing unit. The voltage parameter indicates a level of degradation of the activated one of the pixel circuits and serves as a basis for generation of the reference voltage by the voltage controller.

According to still another aspect of the present invention, a compensation circuit for a display comprises at least one judging device that includes a transistor unit and a comparator. The display includes at least one set of pixel circuits. Each set of the pixel circuits receives a respective set of data voltages, and generates a driving current that corresponds to the respective set of data voltages received thereby. The transistor unit is adapted to be coupled to a corresponding set of pixel circuits. The comparator is coupled to the transistor unit and is adapted to receive a reference current. The comparator receives the driving current generated by the corresponding set of pixel circuits when the transistor unit is turned on, and compares the driving current received thereby to the reference current received thereby so as to generate a comparing signal that is for adjusting the respective set of data voltages when it is determined thereby that the driving current is less than the reference current.

According to a further aspect of the present invention, a compensation circuit for a display comprises at least one judging device that includes a time determining unit and a degradation parameter determining unit. The display includes at least one set of pixel circuits. Each set of pixel circuits receives a respective set of data voltages, and generates a driving current that corresponds to the respective set of data voltages received thereby. The time determining unit is adapted to be coupled to a corresponding set of pixel circuits, and determines a time it takes for the driving current generated by the corresponding set of pixel circuits to reach a threshold value after the corresponding set of pixel circuits are driven by a predetermined test signal that increases according to a predetermined rule. The degradation parameter determining unit is coupled to said time determining unit for generating a degradation parameter with reference to the predetermined test signal and the time determined by said time determining unit. The degradation parameter indicates a level of degradation of the corresponding set of said pixel circuits and serving as a basis for adjusting the respective set of data voltages.

According to still a further aspect of the present invention, a compensation circuit for a display comprises at least one judging device that includes a current comparing unit and a lookup table. The display includes at least one set of pixel circuits. Each pixel circuit in each set receives a respective data voltage, and generates a driving current that corresponds to the respective data voltage received thereby. The current comparing unit is adapted to be coupled to a corresponding set of pixel circuits, and determines a difference between the driving current generated by an activated pixel circuit in the corresponding set and a threshold current value after the activated pixel circuit is driven by a predetermined test signal that increases according to a predetermined rule. The lookup table is coupled to the current comparing unit for locating a voltage parameter with reference to the difference determined by the current comparing unit. The voltage parameter indicates a level of degradation of the activated pixel circuit in the corresponding set and serves as a basis for adjusting the respective data voltage corresponding to the activated pixel circuit.

BRIEF DESCRIPTION OF THE DRAWINGS

Other features and advantages of the present invention will become apparent in the following detailed description of the preferred embodiments with reference to the accompanying drawings, of which:

FIG. 12 is a circuit block diagram of the third preferred embodiment of a display according to the present invention; and FIGS. 13A and 13B are plots illustrating a first scan signal and a second scan signal in the third preferred embodiment.

DETAILED DESCRIPTION OF THE PREFERRED EMBODIMENTS

Figure 1:
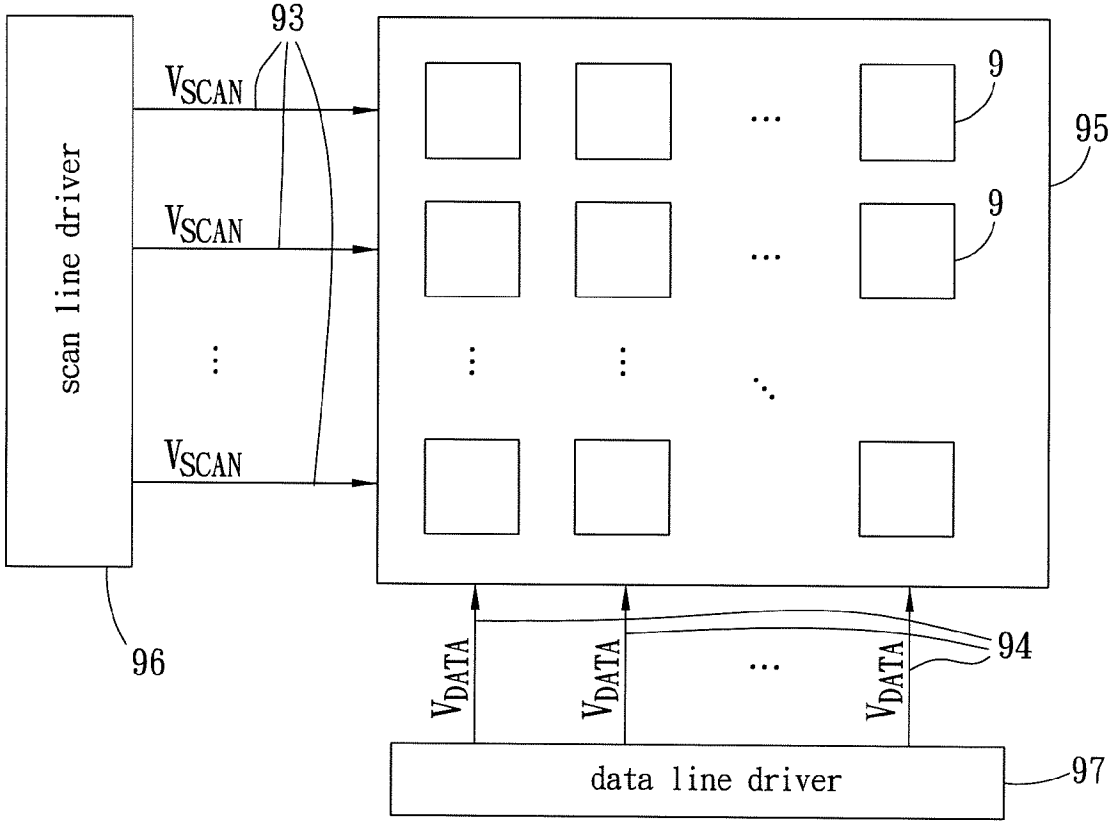
FIG. 1 PRIOR ART
FIG. 1 is a circuit block diagram of a conventional display.
Figure 2:
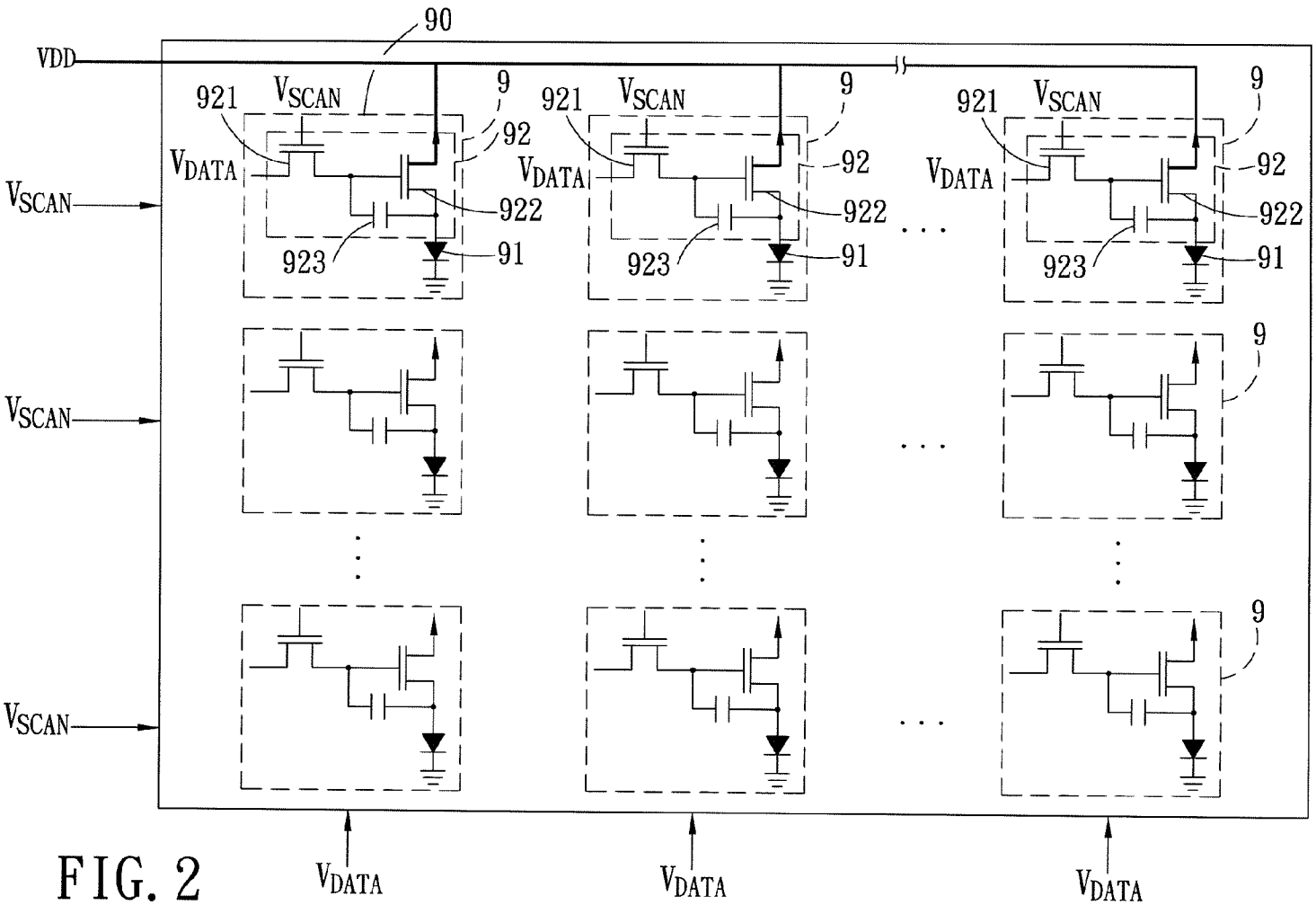
FIG. 2 PRIOR ART
FIG. 2 is a circuit block diagram illustrating pixel circuits of the conventional display.
Figure 3:
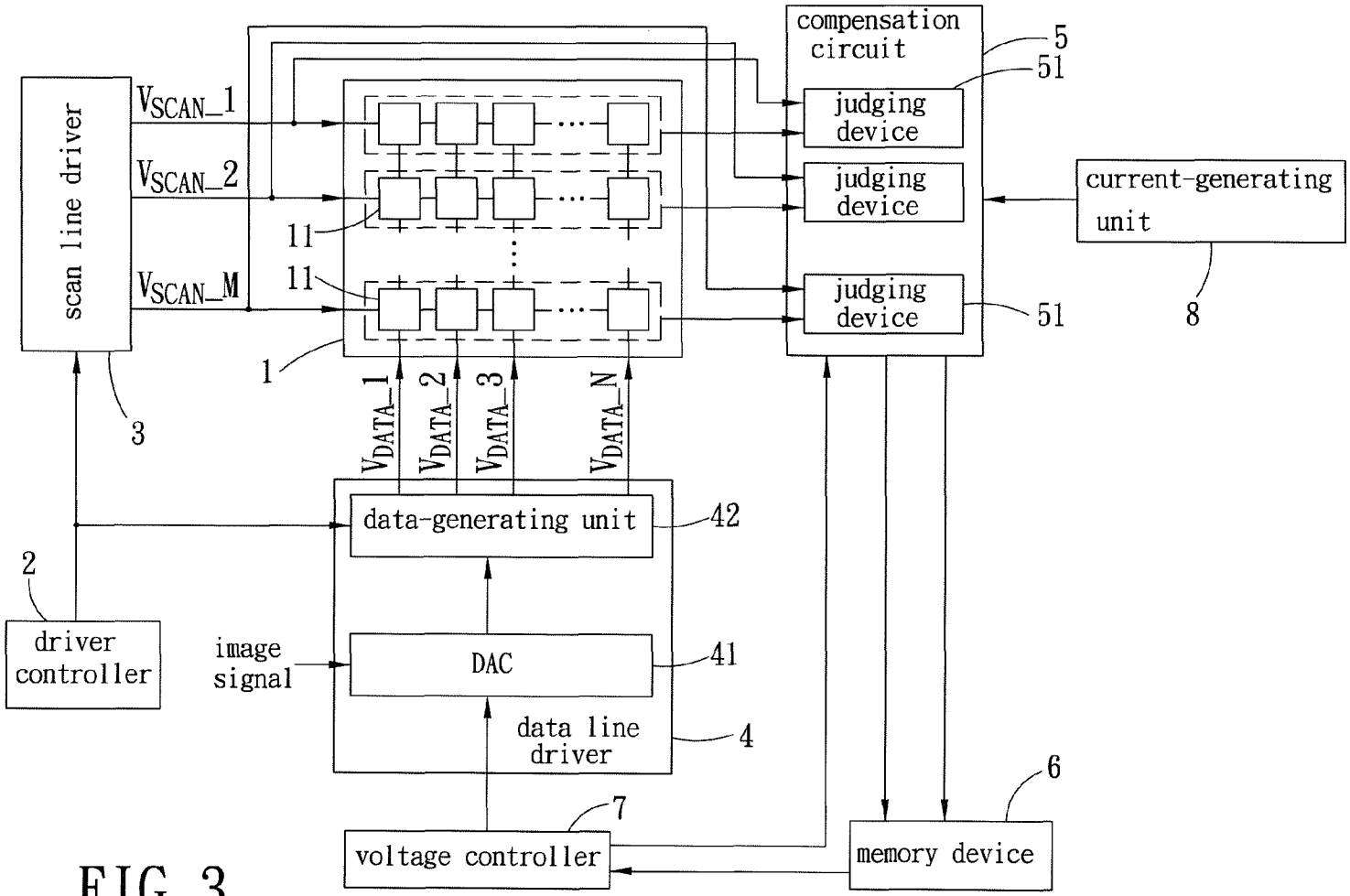
FIG. 3 is a circuit block diagram of the first preferred embodiment of a display according to the present invention.

Referring to FIG. 3, the first preferred embodiment of a display according to this invention is shown to include an array module 1, a compensation circuit 5, a memory device 6, a voltage controller 7, a data line driver 4, and a scan line driver 3.

The array module 1 includes a plurality of scan lines ($V_{SCAN}$_1 to $V_{SCAN}$_M), a plurality of data lines ($V_{DATA}$_1 to $V_{DATA}$_N), and a plurality of pixel circuits 11.

The data lines ($V_{DATA}$_1 to $V_{DATA}$_N) form junctions with each of the scan lines ($V_{SCAN}$_1 to $V_{SCAN}$_M).

Each of the pixel circuits 11 is disposed at a corresponding one of the junctions of the scan lines ($V_{SCAN}$_1 to $V_{SCAN}$_M) and the data lines ($V_{DATA}$_1 to $V_{DATA}$_N).

Figure 4:
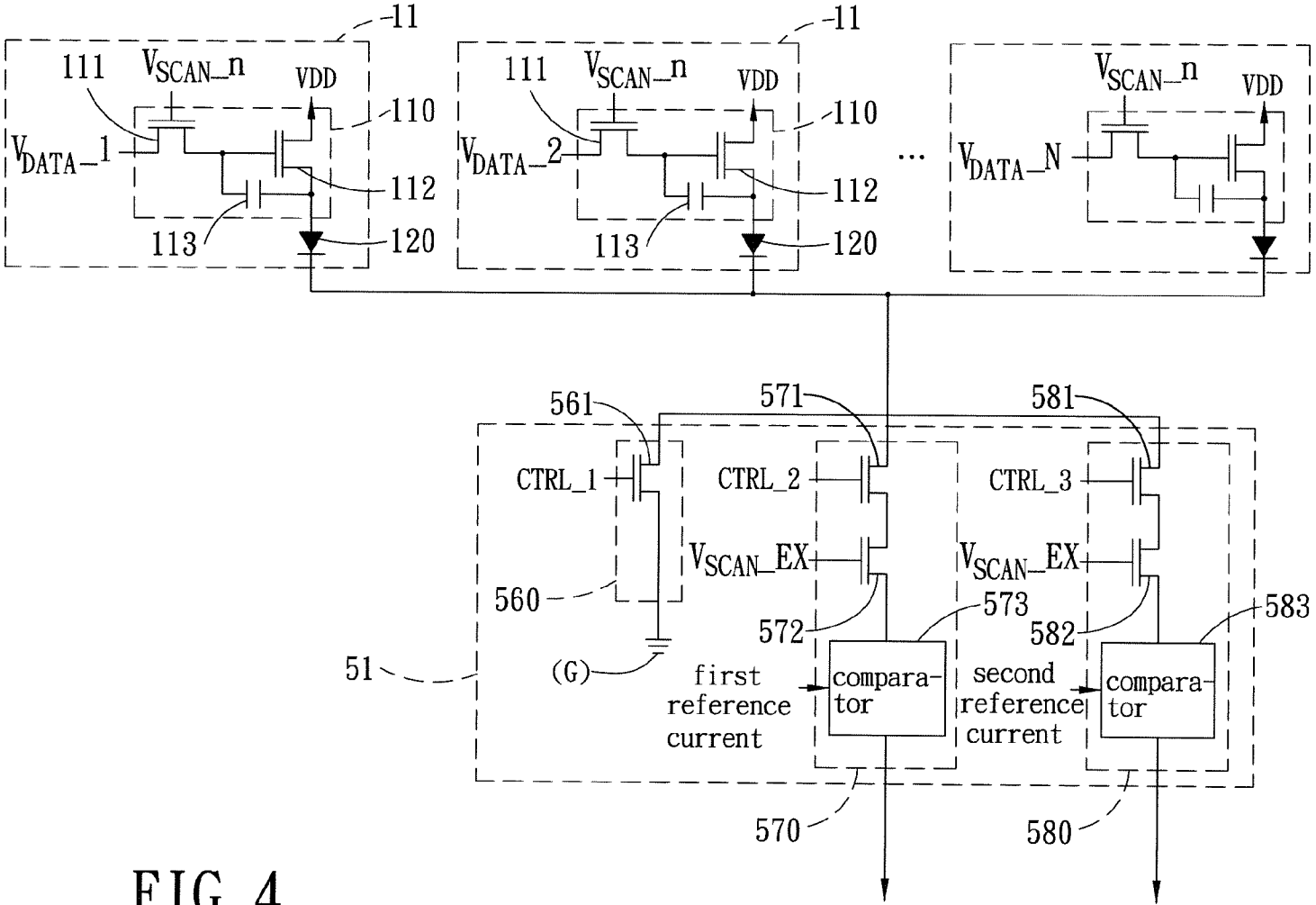
FIG. 4 is a circuit block diagram illustrating a compensation circuit of the first preferred embodiment.

With further reference to FIG. 4, each of the pixel circuits 11 includes a driving member 110, and an organic light-emitting diode (OLED) 120 connected to the driving member 110 thereof.

The compensation circuit 5 is connected to the array module 1. The memory device 6 is connected to the compensation circuit 5. The voltage controller 7 is connected to the memory device 6 and the compensation circuit 5. The data line driver 4 includes a digital-to-analog converter (DAC) 41 connected to the voltage controller 7, and a data-generating unit 42 connected to the DAC 41 and the data lines ($V_{DATA}$_1 to $V_{DATA}$_N). The scan line driver 3 is connected to the scan lines ($V_{SCAN}$_1 to $V_{SCAN}$_M).

In operation, the pixel circuit 11 is activated when a corresponding one of the scan lines ($V_{SCAN}$_1 to $V_{SCAN}$_M) and a corresponding one of the data lines ($V_{DATA}$_1 to $V_{DATA}$_N) are driven. It will become apparent in the following description that the pixel circuits 11 may be driven one at a time, or may be driven in rows (corresponding to the scan lines ($V_{SCAN}$_1 to $V_{SCAN}$_M)). The driving members 110 of a simultaneously activated set of the pixel circuits 11 generate a driving current that drives the OLEDs 120 of the activated set of pixel circuits 11 to emit light. It is noted herein that the activated set of pixel circuits 11 may include a single pixel circuit 11 in some instances. The compensation circuit 5 is operable to detect variation in the driving current, and generates a variation signal and a positioning signal based on the driving current. The positioning signal generated by the compensation circuit 5 indicates a position of the activated set of pixel circuits 11. In the case where the pixel circuits 11 are driven in rows, the positioning signal indicates a position of the corresponding one of the scan lines ($V_{SCAN}$_1 to $V_{SCAN}$_M). The memory device 6 stores the variation signal and the positioning signal generated by the compensation circuit 5. The voltage controller 7 reads the variation signal and the positioning signal stored in the memory device 6, and generates a reference voltage that corresponds to the positioning signal with reference to the variation signal. The DAC 41 receives an image signal, corrects the image signal received thereby based on the reference voltage generated by the voltage controller 7, and generates analog data that correspond to the image signal corrected thereby. The data-generating unit 42 generates a plurality of data voltages that correspond to the analog data generated by the DAC 41 and that are used for driving the data lines ($V_{DATA}$_1 to $V_{DATA}$_N).

From the foregoing description, since the compensation circuit 5 generates the variation signal that corresponds to the variation in the driving current, since the DAC 41 corrects the image signal received thereby based on the variation signal generated by the compensation circuit 5, and since the data-generating unit 42 generates the data voltages based on the image signal corrected by the DAC 41, the driving current generated by the driving member 110 of the pixel circuit 11 is adjusted accordingly.

The display further includes a driver controller 2 connected to the scan line driver 3, and controlling the scan line driver 3 to drive the scan lines ($V_{SCAN}$_1 to $V_{SCAN_{13}}$ M). The compensation circuit 5 includes a plurality of judging devices 51 corresponding in number to the scan lines ($V_{SCAN}$_1 to $V_{SCAN}$_M). Since the judging devices 51 are identical in structure, only one of the judging devices 51 that corresponds to the scan line ($V_{SCAN}$_n) will be described herein.

With reference to FIG. 4, the judging device 51 includes first, second, and third circuit members 560, 570, 580. The first circuit member 560 includes a transistor 561 connected to the OLEDs 120 of the pixel circuits 11 on the junctions of the data lines ($V_{DATA}$_1 to $V_{DATA}$_N) and the scan line ($V_{SCAN}$_n), and an electrical ground (G) connected to the transistor 561 thereof. The second circuit member 570 includes a first transistor 571 connected to the OLEDs 120 of the pixel circuits 11 on the junctions of the data lines ($V_{DATA}$_1 to $V_{DATA}$_N) and the scan line ($V_{SCAN}$_n), a second transistor 572 connected to the first transistor 571 thereof, and a comparator 573 connected to the second transistor 572 thereof. The third circuit member 580 includes a first transistor 581 connected to the OLEDs 120 of the pixel circuits 11 on the junctions of the data lines ($V_{DATA}$_1 to $V_{DATA}$_N) and the scan line ($V_{SCAN}$_n), a second transistor 582 connected to the first transistor 581 thereof, and a comparator 583 connected to the second transistor 582 thereof.

The judging device 51 is operable in a normal operation mode, and first and second detection modes. In the following description, it is assumed that the scan line ($V_{SCAN}$_n) is driven at all times.

When the judging device 51 operates in the normal operation mode, i.e., the transistor 561 of the first circuit member 560 is turned on, while the first transistors 571, 581, of the first and second circuit members 570, 580 are turned off, the driving currents generated by the pixel circuits 11 as a result of the data lines ($V_{DATA}$_1 to $V_{DATA}$_N) being driven with the analog data that correspond to the image signal are grounded by the compensation circuit 5. In other words, the display operates in a fashion similar to that of the prior art.

Figure 5A:
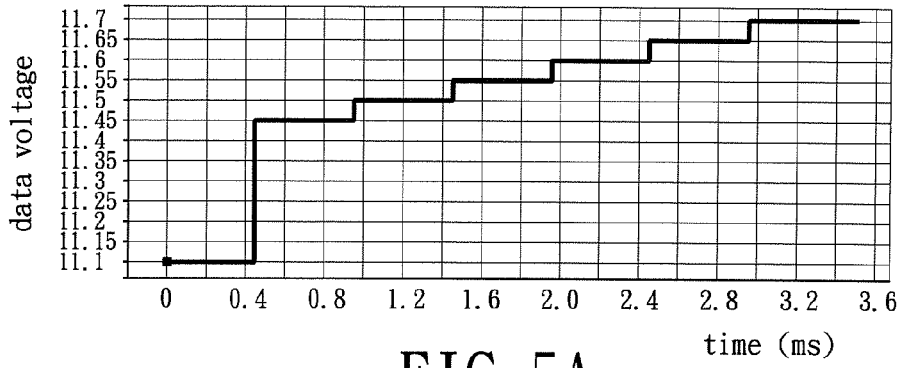
FIGS. 5A to 5C are plots illustrating relationships among a data voltage, a driving current, and a comparing signal generated by the first preferred embodiment.
Figure 5B:
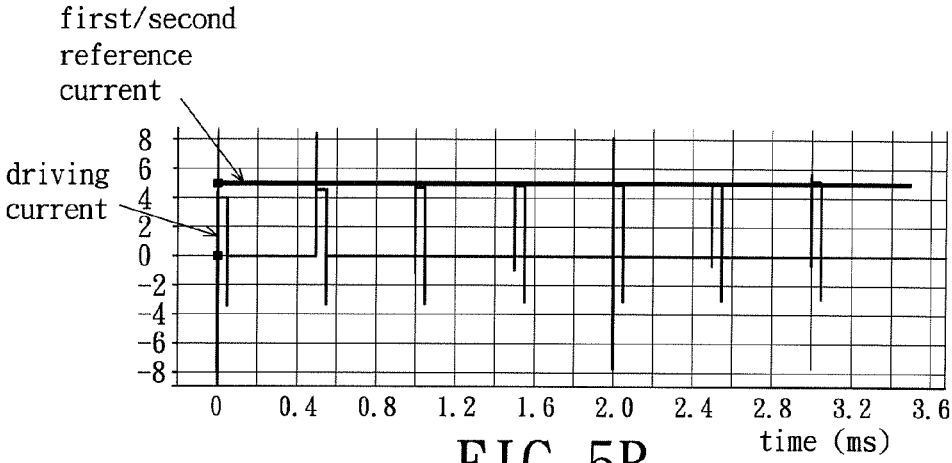
Figure 5C:
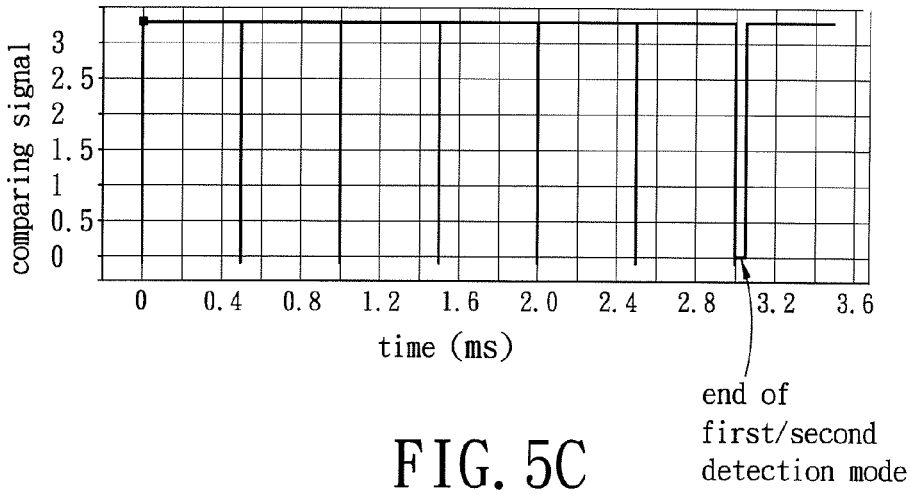

When the judging device 51 operates in the first detection mode, i.e., the first transistor 571 of the second circuit member 570 is turned on, while the transistor 561 of the first circuit member 560 and the first transistor 581 of the third circuit member 580 are turned off, the data lines ($V_{DATA}$_1 to $V_{DATA}$_N) are driven with a predetermined test signal one at a time. In other words, in each detection cycle, the data line driver 4 is operable to drive one of the data lines ($V_{DATA}$_1 to $V_{DATA}$_N) that corresponds to an activated one of the pixel circuits with the predetermined test signal. At this time, when the second transistor 572 of the second circuit member 570 is turned on, the comparator 573 of the second circuit member 570 receives the driving current generated by the driving member 110 of the activated one of the pixel circuits 11, and compares the driving current received thereby to a first reference current. As illustrated in FIGS. 5A to 5C, when the comparator 573 of the second circuit member 570 determines that the driving current is less than the first reference current, i.e., the driving current is too low, the comparing signal generated by the compensation circuit 5 is a high level signal, indicating that there needs to be an increase in the predetermined test signal so as to bring the driving current to be level with the first reference current. The judging device 51 remains in this mode until the comparator 573 of the second circuit member 570 determines that the driving current is equal to or greater than the first reference current. In this case, the comparing signal is a low level signal. To this end, the data line driver 4 is operable to correct the predetermined test signal in steps according to a predetermined adjustment signal until the reference voltage from the voltage controller 7 indicates transition of the comparing signal from the high level signal to the low level signal. In addition, the voltage controller 7 generates the reference voltage based on the predetermined adjustment signal and a number of steps taken to correct the predetermined test signal.

When the judging device 51 operates in the second detection mode, i.e., the first transistor 581 of the third circuit member 580 is turned on, while the transistor 561 of the first circuit member 560 and the first transistor 571 of the second circuit member 570 are turned off, the data lines ($V_{DATA}$_1 to $V_{DATA}$_N) are driven by the data voltages generated by the data-generating unit 42 of the data line driver 4 with the predetermined test signal at the same time. In other words, in each detection cycle, the data line driver 4 is operable to drive each of said data lines ($V_{DATA}$_1 to $V_{DATA}$_N) with the predetermined test signal. At this time, when the second transistor 582 of the third circuit member 580 is turned on, the comparator 583 of the third circuit member 580 receives the driving current generated by the activated set of pixel circuits 11 (including all of the pixel circuits 11 on the junction of the data lines ($V_{DATA}$_1 to $V_{DATA}$_N) and the scan lines ($V_{SCAN}$_n)), and compares the driving current received thereby to a second reference current. As illustrated in FIGS. 5A to 5C, when the comparator 583 of the third circuit member 580 determines that the driving current is less than the second reference current, the comparing signal is the high level signal, indicating that there needs to be an increase in the predetermined test signal so as to bring the driving current to be level with the second reference current. The judging device 51 remains in this mode until the comparator 583 of the third circuit member 580 determines that the driving current is equal to or greater than the second reference current. In this case, the comparing signal becomes the low level signal. To this end, as with the first detection mode, the data line driver 4 is operable to correct the predetermined test signal in steps according to the predetermined adjustment signal until the reference voltage from said voltage controller indicates transition of the comparing signal from the high level signal to the low level signal. In addition, the voltage controller 7 generates the reference voltage based on the predetermined adjustment signal and the number of steps taken to correct the predetermined test signal.

The second detection mode differs from the first detection mode in that the first detection mode detects variations occurring in the pixel circuits 11 one at a time, while the second detection mode detects variations occurring in a row of pixel circuits 11. The second detection mode is advantageous over the first detection mode in that less time is required for detecting variations occurring in all pixel circuits 11 in the display such that display quality of the display is less affected.

It is noted herein that the analog data derived from the image signal that is received by the DAC 41 contains desirable contents for a viewer of the display. The analog data corresponding to the desirable image signal is replaced by the predetermined test signal when the judging device(s) 15 of the compensation circuit 5 operates/operate in the first and second detection modes. However, this does not affect how the user perceives images on the display due to the minimal time it takes for detection and also due to persistence of vision.

When the judging device 51 is either in the first or second detection mode, the data voltages generated by the data-generating unit 42 are initially of equal magnitude (i.e., the predetermined test signal).

The display further includes a current-generating unit 8 connected to the compensation circuit 5 and generating the first and second reference currents.

The transistor 561 of the first circuit member 560 and the first transistors 571, 581 of the second and third circuit members 570 and 580 are turned on and off by control signals (CTRL_1, CTRL_2, CTRL_3), respectively. The control signals (CTRL_1, CTRL_2, CTRL_3) may be generated by a device (not shown) external to the display or by the display itself, e.g., the voltage controller 7 of the display.

The second transistors 572, 582 of the second and third circuit members 570 and 580 are turned on and off by a scan signal ($V_{scan}$_EX), which may be the signal that drives the scan line ($V_{SCAN}$_n) corresponding to the activated one/set of the pixel circuit 11 or another signal that is generated by the scan line driver 3.

Figure 6:
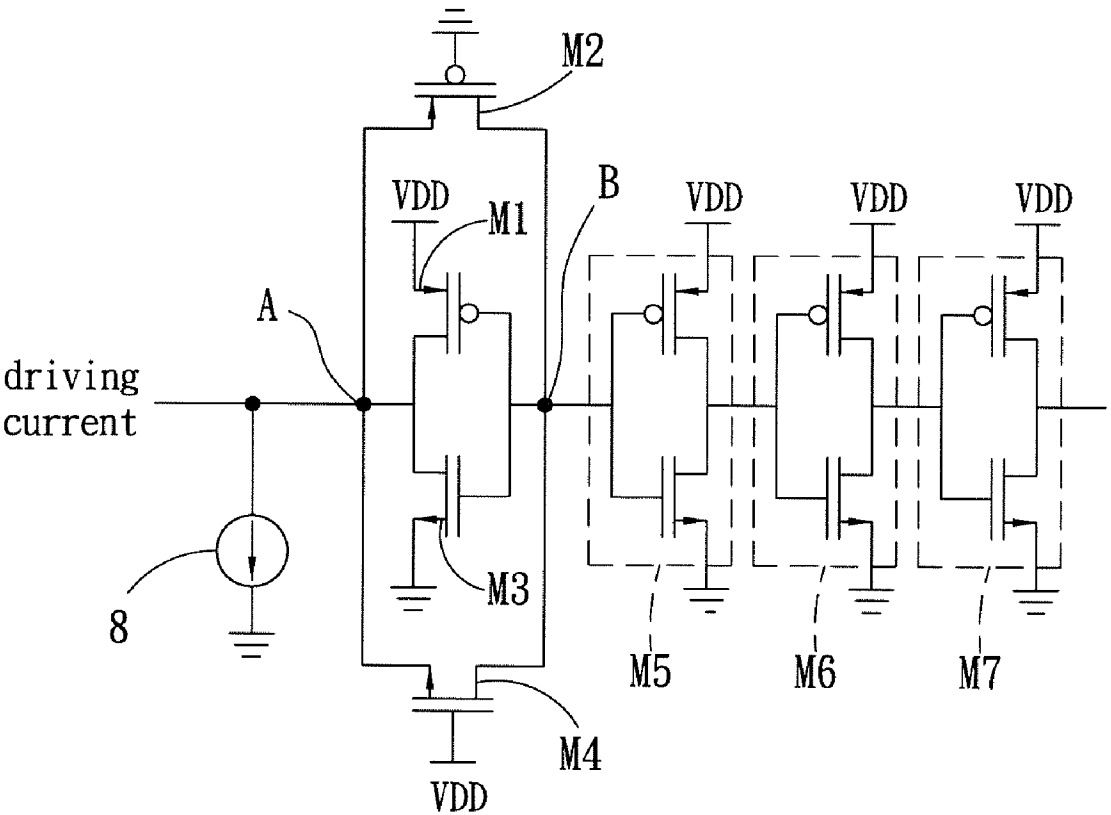
FIG. 6 is a circuit diagram of a comparator of the first preferred embodiment.

With further reference to FIG. 6, the comparator 573, 583 of each of the second and third circuit members 570, 580 includes first and second p-type transistors (M1, M2), first and second n-type transistors (M3, M4), and first, second, and third complementary metal oxide semiconductor (CMOS)

inverters (M5, M6, M7). Each of the first and second p-type transistors (M1, M2) and the first and second n-type transistors (M3, M4) has first, second, and control terminals. Each of the first, second, and third CMOS inverters (M5, M6, M7) has input and output terminals.

The first terminals of the first p-type transistor (M1) and the first n-type transistors (M3), and the second terminals of the second p-type transistor (M2) and the second n-type transistor (M4) are connected to a first node (A). The control terminals of the first p-type transistor (M1) and the first n-type transistor (M3), the first terminals of the second p-type transistor (M2) and the second n-type transistor (M3), and the input terminal of the first CMOS inverter (M5) are connected to a second node (B). The input terminal of the second CMOS inverter (M6) is connected to the output terminal of the first CMOS inverter (M5). The input terminal of the third CMOS inverter (M7) is connected to the output terminal of the second CMOS inverter (M6).

The current-generating unit 8 is further connected to the first node (A). The driving current generated by the activated one of the pixel circuits 11 is inputted through the first node (A). The comparing signal generated by the comparator 573 of the second circuit member 570 is outputted through the output terminal of the third CMOS inverter (M7) of the comparator 573 of the second circuit member 570. The comparing signal generated by the comparator 583 of the third circuit member 580 is outputted through the output terminal of the third CMOS inverter (M7) of the comparator 583 of the third circuit member 580.

The driving member 110 of each of the pixel circuits 11 has a 2T1C structure. That is, the driving member 110 includes first and second transistors 111, 112 and a capacitor 113. Each of the first and second transistors 111, 112 of the driving member 110 has first and second terminals, and a control terminal. The capacitor 113 of the driving member 110 has first and second terminals. The OLED 120 of each of the pixel circuits 11 has anode and cathode terminals.

The control terminal of the first transistor 111 of the driving member 110 is connected to the scan line ($V_{SCAN}$_n). The second terminal of the first transistor 111 of the driving member 110, the control terminal of the second transistor 112 of the driving member 110, and the first terminal of the capacitor 113 of the driving member 110 are connected to each other. The second terminal of the capacitor 113 of the driving member 110, the second terminal of the second transistor 112 of the driving member 110, and the anode terminal of the OLED 120 are connected to each other. The first terminal of the second transistor 112 receives a supply voltage (VDD). The cathode terminal of the OLED 120 is connected to the compensation circuit 5.

When the scan line ($V_{SCAN}$_n) is driven by a high level scan signal, the first transistor 111 of the driving member 110 is turned on. At this time, a data voltage is applied to the first terminal of the capacitor 113 of the driving member 110, whereby a capacitor voltage, which corresponds to the data voltage, appears across the capacitor 113 of the driving member 110. On the other hand, when the scan line ($V_{SCAN}$_n) is driven by a low level scan signal, the first transistor 111 of the driving member 110 is turned off. At this time, the capacitor voltage across the capacitor 113 of the driving member 110 is maintained, and the second transistor 112 of the driving member 110 is biased by the capacitor voltage and the supply voltage (VDD) into a saturated region and generates the driving current. The driving current ($I_{DRIVE}$) generated by an activated pixel circuit 11 (as opposed to generated by multiple simultaneously activated pixel circuits 11) is given by $$\begin{aligned} I_{DRIVE} &= \frac{1}{2}k_{112}(V_{GS,112} - V_{TH,112})^2 \\ &= \frac{1}{2}k_{112}[V_{DATA} - V_{OLED} - V_{TH,112}]^2 \\ &= \frac{1}{2}k_{112}[V_{DATA} - (V_{OLED0} + \Delta V_{OLED}) - (V_{TH0,112} + \Delta V_{TH,112})]^2 \\ &= \frac{1}{2}k_{112}[(V_{DATA0} + V_{Diff}) - (V_{OLED0} + \Delta V_{OLED}) - \\ &\quad (V_{TH0,112} + \Delta V_{TH,112})]^2 \\ &= \frac{1}{2}k_{112}[V_{DATA0} - V_{OLED0} - V_{TH0,112}]^2 \end{aligned}$$

where $k_{112}$ is a device trans-conductance parameter of the second transistor 112 of the driving member 110, $V_{GS,112}$ is a voltage across the second transistor 112 of the driving member 110, $V_{TH,112}$ is a threshold voltage of the second transistor 112 of the driving member 110, $V_{OLED}$ is an anode voltage of the OLED 120, $V_{OLED0}$ is an initial anode voltage of the OLED 120, $\Delta V_{OLED0}$ is a deviation from the initial anode voltage of the OLED 120, $V_{TH0,112}$ is an initial threshold voltage of the second transistor 112 of the driving member 110, and $\Delta V_{TH,112}$ is a deviation from the initial threshold voltage of the second transistor 112 of the driving member 110. It should be noted herein that the driving current generated by multiple simultaneously activated pixel circuits 11 (or an activated set of pixel circuits 11) is an integer multiple of $I_{DRIVE}$ in the above equation, depending on the number of pixel circuits 11 in the activated set.

As in the above equation, when the initial data voltage ($V_{DATA0}$) is adjusted to $V_{DATA}=V_{DATA0}+V_{Diff}$ and when $V_{Diff}=V_{STEP}*n=\Delta V_{OLED}+\Delta V_{TH,112}$ (where $V_{Diff}$ corresponds to the reference voltage, $V_{STEP}$ is the predetermined adjustment signal, and n represents the number of steps taken to correct the predetermined test signal), the driving current ($I_{DRIVE}$) can be simply associated with the initial data voltage ($V_{DATA0}$), the initial anode voltage ($V_{OLED0}$) of the OLED 120, and the threshold voltage ($V_{TH0,112}$) of the second transistor 112 of the driving member 110.

It is noted that since the initial anode voltages ($V_{OLED0}$) of the OLEDs 120 of the pixel circuits 11 are of equal magnitude and the threshold voltages ($V_{TH0,112}$) of the second transistors 112 of the driving members 110 of the pixel circuits 11 are of equal magnitude, only the initial data voltage ($V_{DATA0}$) affects the driving current ($I_{DRIVE}$).

In other words, after correcting the predetermined test signal based on $V_{Diff}=\Delta V_{OLED}+\Delta V_{TH,112}$, $I_{DRIVE}$ of every pixel circuit 11 is of substantially equal magnitude. This results in an improved uniformity in the light-emitting efficiencies of the OLEDs 120 of the pixel circuits 11 when the reference voltage that corresponds to $V_{Diff}$ is used to correct the desirable image signal.

Figure 7:
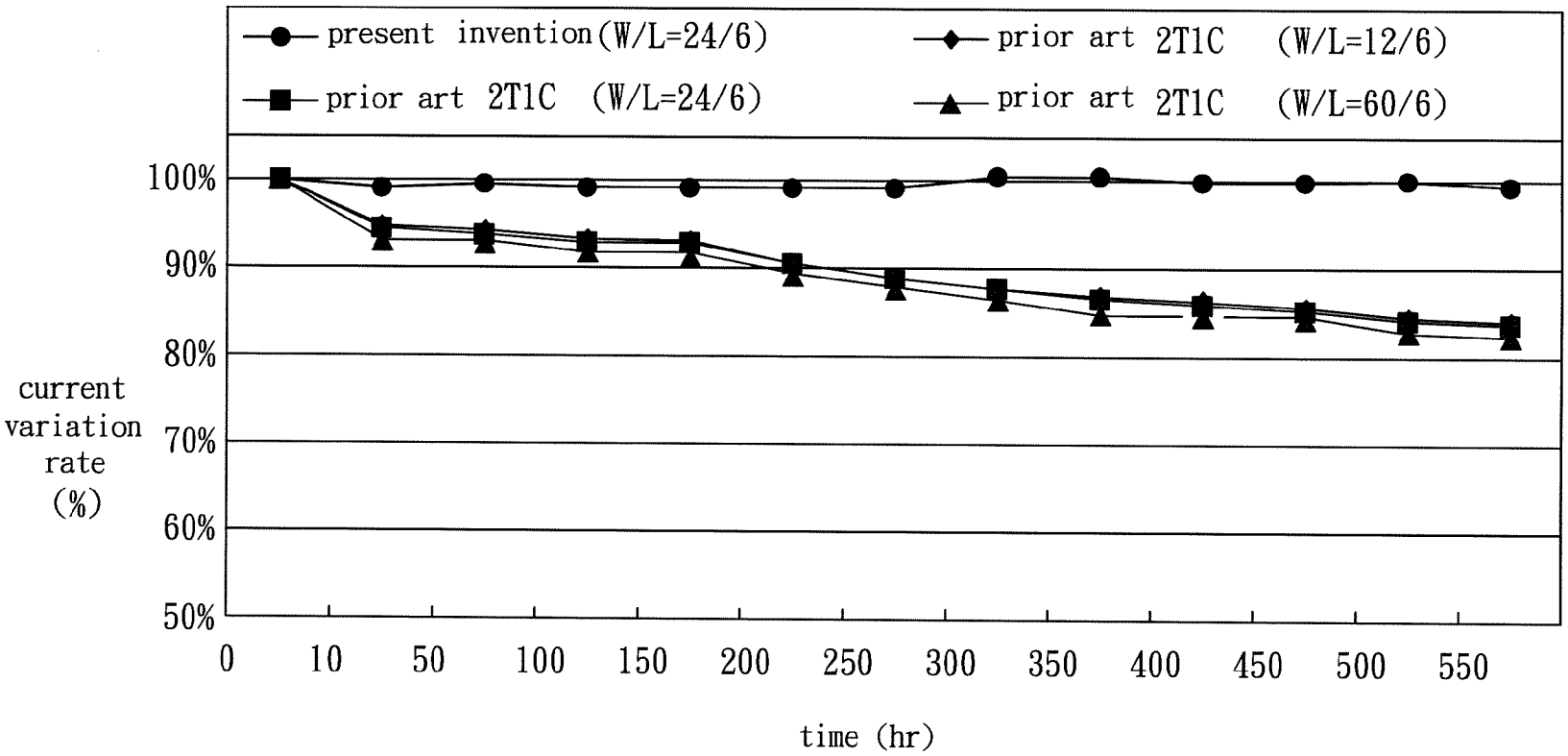
FIG. 7 is a plot illustrating a driving current generated by the first preferred embodiment.

As illustrated in FIG. 7, regardless of the width-length ratio (W/L) of a second transistor of a pixel circuit in a conventional display, a driving current generated by the pixel circuit of the conventional display is decreased by 20% over time. The driving current generated by the pixel circuit 11 of the display of this invention, however, is maintained at a constant magnitude over time.

Figure 8:
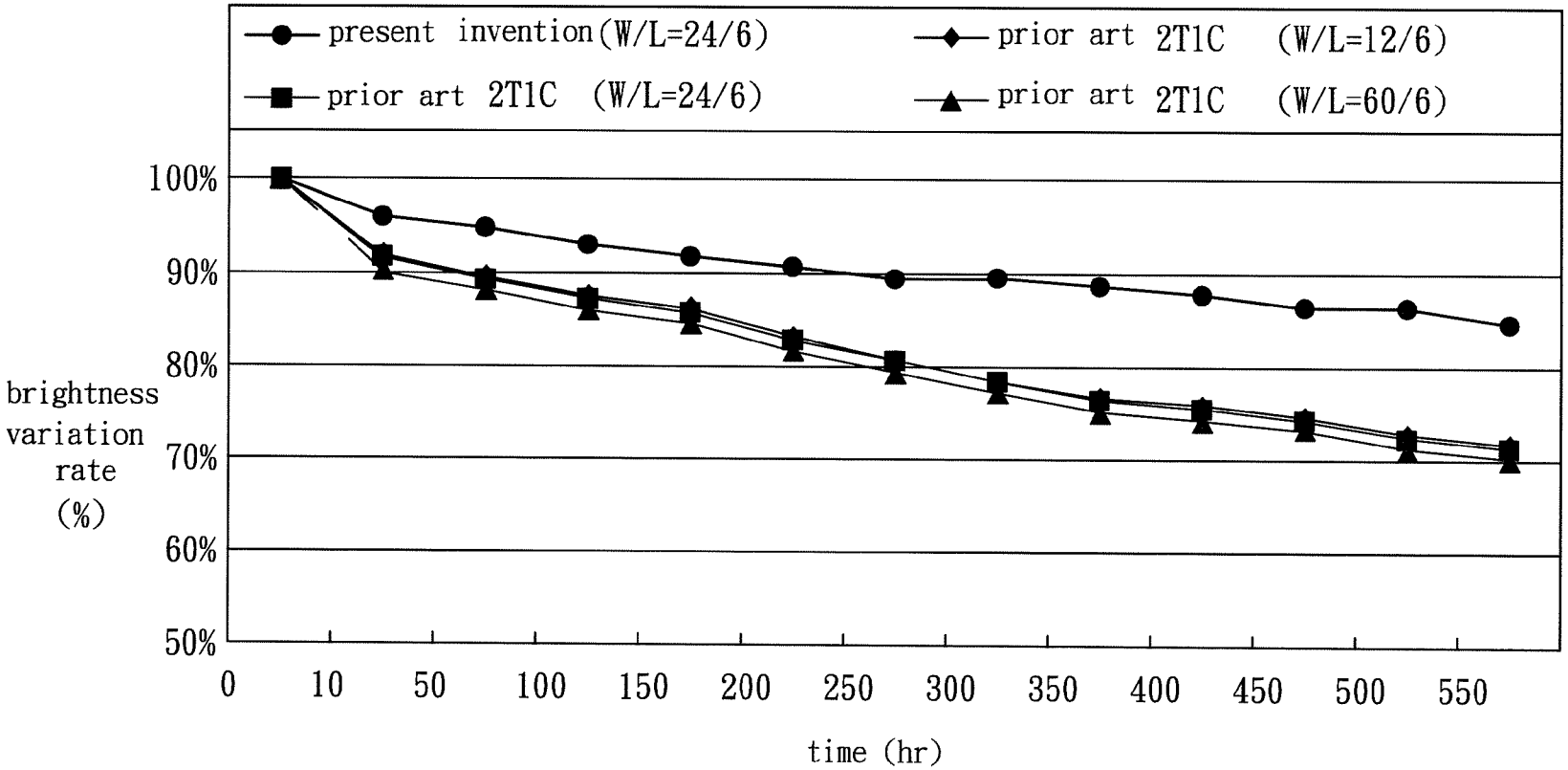
FIG. 8 is a plot illustrating a brightness level of an organic light-emitting diode (OLED) of the first preferred embodiment.

As illustrated in FIG. 8, when compared to the conventional display, the brightness level of the display of this invention is decreased only by a small amount over time.

The first preferred embodiment disclosed in the foregoing description is mainly related to utilizing one judging device 51 for detecting variations in the driving current generated by either a single pixel circuit 11 coupled thereto or by a whole row of the pixel circuits 11 connected thereto, so as to allow the voltage controller 7 to generate the reference voltage corresponding to the variation in the driving current in order to compensate for the variation and to enhance uniformity of intensities of lights emitted by the OLEDs 120 of the pixel circuits 11.

Figure 9:
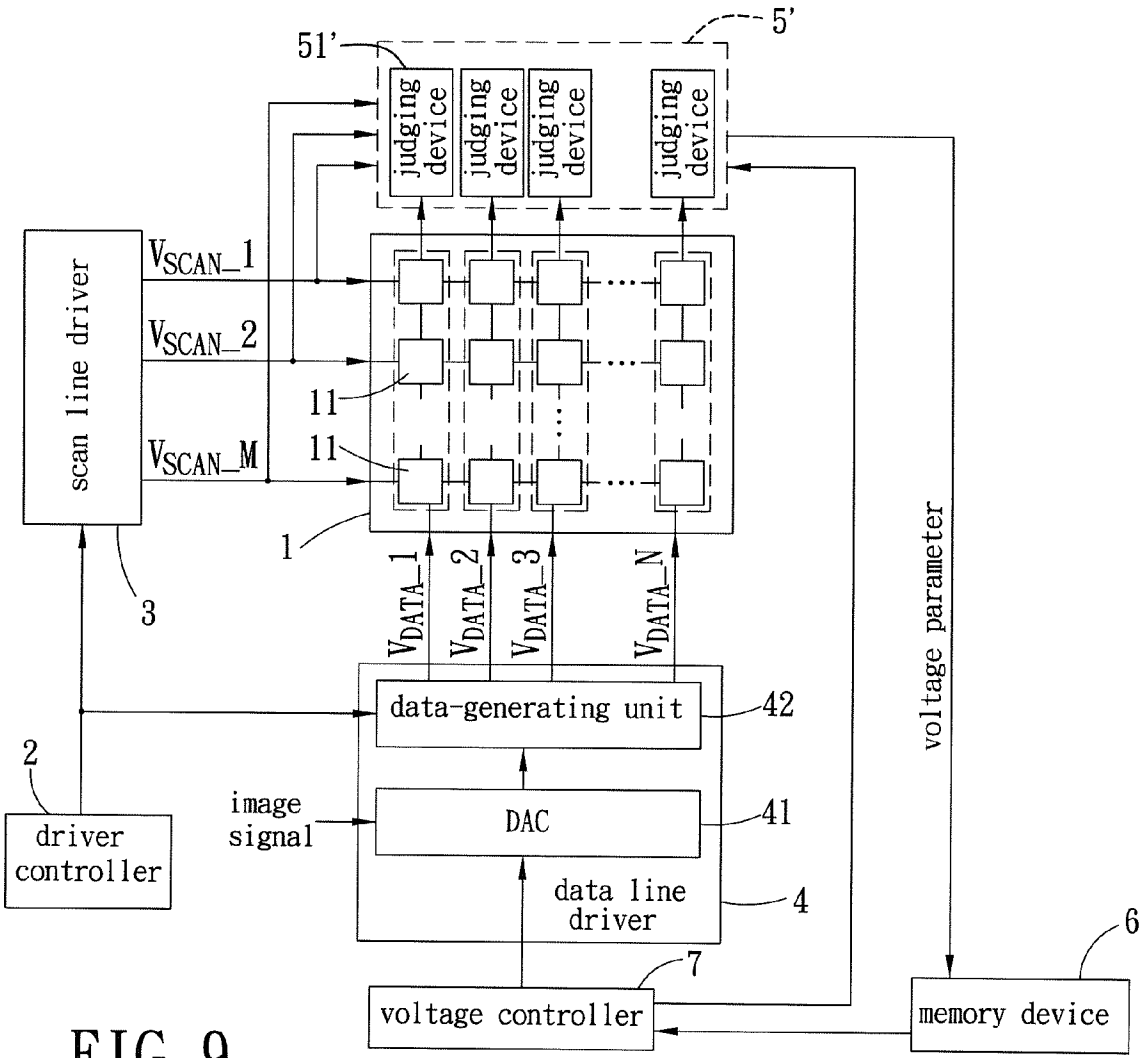
FIG. 9 is a circuit block diagram of the second preferred embodiment of a display according to the present invention.

As illustrated in FIG. 9, the second preferred embodiment of a display according to this invention performs compensation of one pixel circuit 11 at a time in columns instead of performing compensation of one pixel circuit 11 at a time in rows (as with the first detection mode of the first preferred embodiment), and the compensation circuit 5' also performs detection in a different manner. As shown, the compensation circuit 5' includes a plurality of judging devices 51' corresponding in number to the data lines ($V_{DATA}$_1 to $V_{DATA}$_N) for detecting variations in the driving currents generated by each of the pixel circuits 11 in the corresponding column. In particular, when one of the scan lines ($V_{SCAN}$_1 to $V_{SCAN}$_M) and one of the data lines ($V_{DATA}$_1 to $V_{DATA}$_N) are driven, the pixel circuit 11 on the junctions of said one of the scan lines ($V_{SCAN}$_1 to $V_{SCAN}$_M) and said one of the data lines ($V_{DATA}$_1 to $V_{DATA}$_N) is activated, and generates a driving current that drives the light-emitting member 120 thereof to emit light.

Figure 10A:
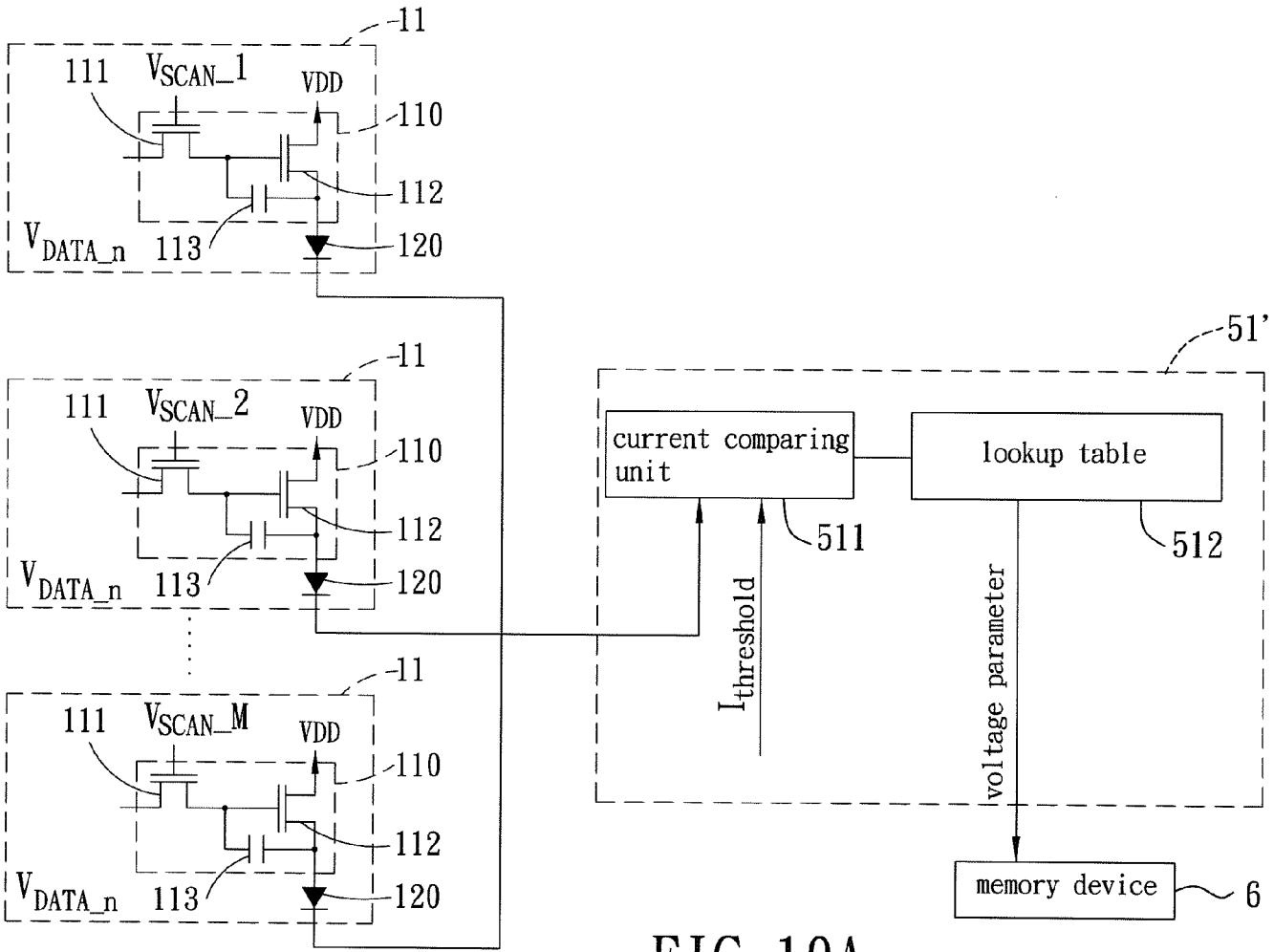
FIG. 10A is a circuit block diagram illustrating a compensation circuit according to the first implementation of the second preferred embodiment.

It is noted herein that descriptions related to the normal operation mode will be omitted herein for the sake of brevity. As shown in FIG. 10A, according to one implementation of the second preferred embodiment, in a detection mode, the compensation circuit 5' is operable so as to generate a voltage parameter based on the driving current generated by an activated one of the pixel circuits 11. Since the judging devices 51' are identical in structure, only one of the judging devices 51' that corresponds to the data line ($V_{DATA}$_n) will be described herein. The judging device 51' includes a current comparing unit 511 and a lookup table 512. The current comparing unit 511 is coupled to a corresponding set of the pixel circuits 11 that are disposed at the junctions of the scan lines ($V_{SCAN}$_1 to $V_{SCAN}$_M) and the data line ($V_{DATA}$_n), and determines a difference between the driving current generated by an activated one of the pixel circuits 11 in the corresponding set and a threshold current value ($I_{threshold}$) after the pixel circuit 11 is driven by a predetermined test signal. The lookup table 512 is coupled to the current comparing unit 511 for locating the voltage parameter with reference to the difference thus determined by the current comparing unit 511. The voltage parameter corresponds to a level of degradation of the activated one of the pixel circuits 11 and serves as a basis for generation of the reference voltage by the voltage controller 7. The voltage controller 7 generates the reference voltage that corresponds to the positioning of the activated one of the pixel circuits 11 with reference to the voltage parameter.

Preferably, the data line ($V_{DATA}$_n) is driven by a voltage greater than the supply voltage (VDD) so as to ensure that the second transistor 112 of the driving member 110 of the pixel circuits 11 in the corresponding set operates in the linear region (or in essence, as a switch) such that the OLED 120 switches between emitting light and not emitting light.

Figure 10B:
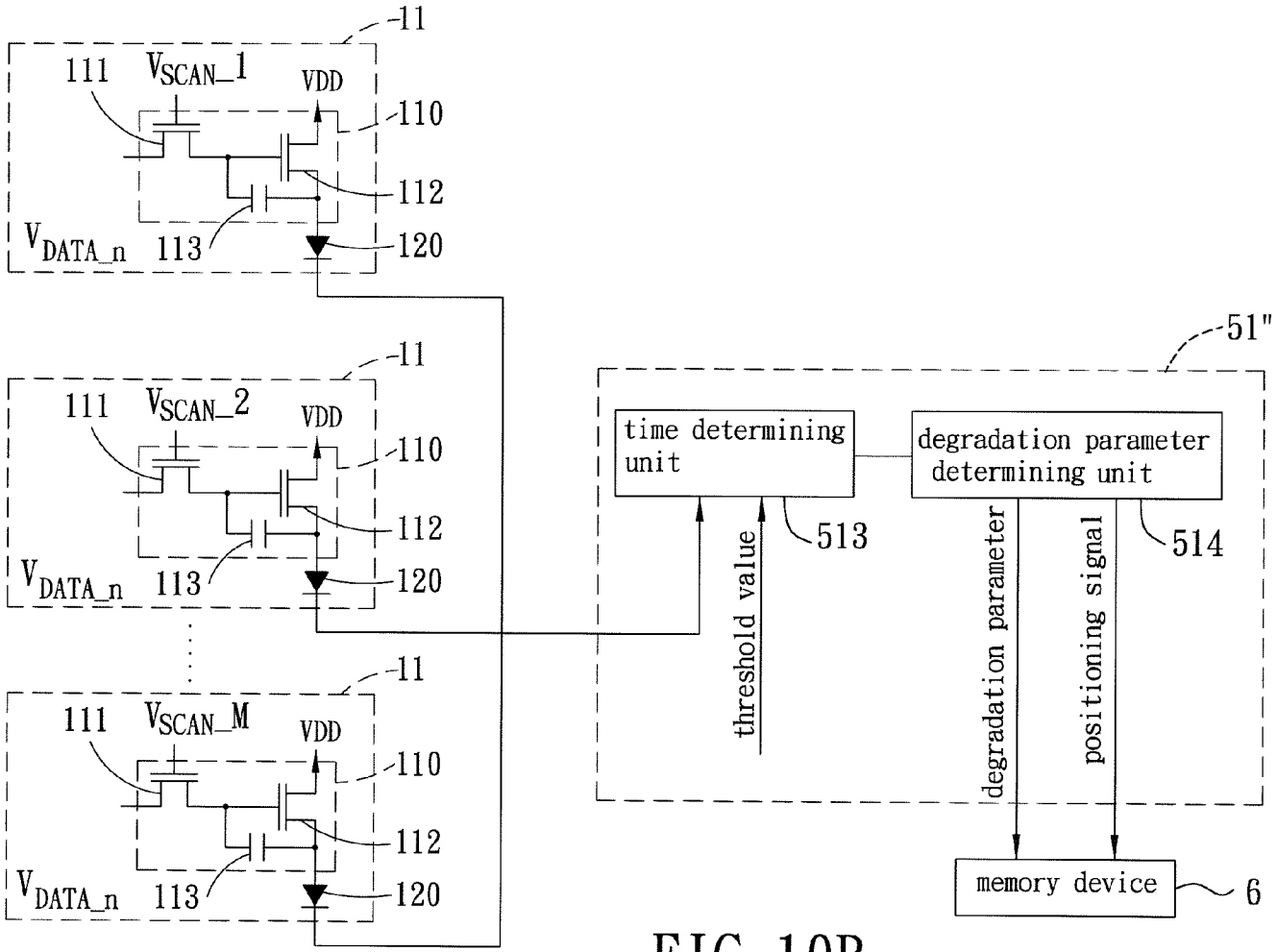
FIG. 10B is a circuit block diagram illustrating a compensation circuit according to the second implementation of the second preferred embodiment.

With reference to FIG. 10B, according to another implementation of the second preferred embodiment, in a detection mode, the compensation circuit 5" is operable so as to generate a degradation parameter and the positioning signal based on the driving current generated by an activated one of the pixel circuits 11 in the corresponding set. The positioning signal indicates a position of one of the data lines ($V_{DATA}$_1 to $V_{DATA}$_N) that corresponds to the set of the pixel circuits 11. Since the judging devices 51" are identical in structure, only one of the judging devices 51" that corresponds to the data line ($V_{DATA}$_n) will be described herein.

In particular, the judging device 51" includes a time determining unit 513 and a degradation parameter determining unit 514. The time determining unit 513 is coupled to the corresponding set of the pixel circuits 11 that are disposed at the junctions of the scan lines ($V_{SCAN}$_1 to $V_{SCAN}$_M) and the data line ($V_{DATA}$_n), and determines the time it takes for the driving current generated by an activated one of the pixel circuits 11 in the corresponding set (including all of the pixel circuits 11 on the junction of the scan lines ($V_{SCAN}$_1 to $V_{SCAN}$_M) and the data line ($V_{DATA}$_n)) to reach a threshold value after the pixel circuit 11 is driven by a predetermined test signal that increases according to a predetermined rule. The degradation parameter determining unit 514 is coupled to the time determining unit 513 for generating the degradation parameter with reference to the predetermined test signal and the time determined by the time determining unit 513. The degradation parameter indicates a level of degradation of the corresponding set of the pixel circuits 11 and serves as a basis for generation of the reference voltage by the voltage controller 7. The voltage controller 7 generates the reference voltage that corresponds to the positioning signal with reference to the degradation parameter.

Figure 11A:
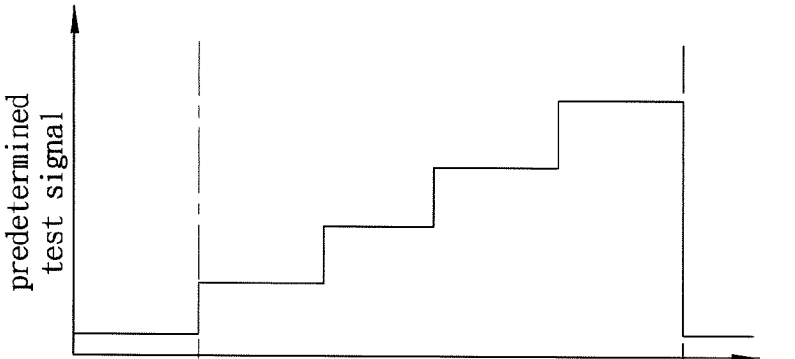
FIGS. 11A to 11B are plots illustrating a predetermined test voltage and a scan signal in the second preferred embodiment.
Figure 11B:
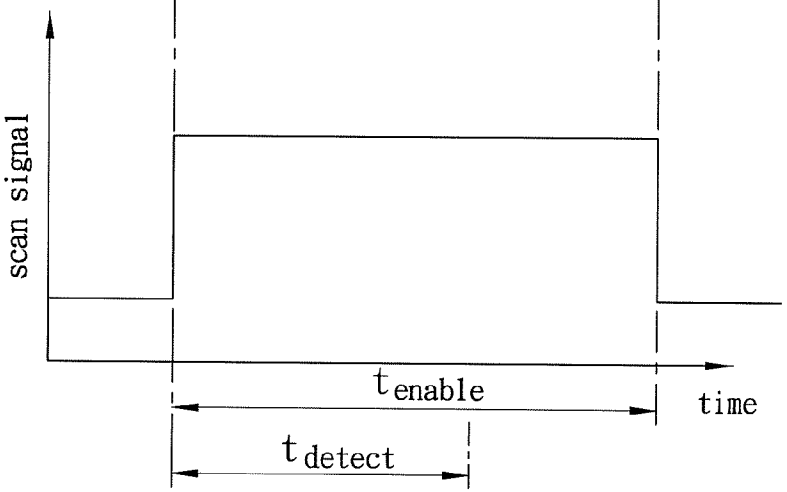

As illustrated in FIG. 11, the predetermined test signal increases by fixed steps in fixed intervals of time. The degradation parameter is determined according to the following formula:

$$\text{degradation parameter} = \Delta V \cdot \frac{t_{dectect}}{t_{enable}}$$

where ΔV is the total amount of increase in the predetermined test signal over a predetermined time span that said one of the scan lines ($V_{SCAN}$_1 to $V_{SCAN}$_M) is driven, $t_{detect}$ is the time determined by the time determining unit 513, and $t_{enable}$ is the predetermined time span.

The longer the OLED 120 is used, the greater the amount of driving current, and accordingly the greater the amount of data voltage, that is necessary for the OLED 120 to emit light. In this implementation of the second preferred embodiment, since the predetermined test signal increases as the time $t_{detect}$ increases, the greater the length of the time $t_{detect}$, the greater the degradation parameter, indicating a greater degradation in the OLED 120.

Therefore, when the degradation parameter indicates a greater degradation, the reference voltage generated by the voltage controller 7 is greater such that more correction can be made to the image signal when the compensation circuit 5" operates in the normal mode (please refer to the disclosure for the first preferred embodiment).

It should be noted herein that the manner in which variations in the driving current is detected as disclosed in the two implementations of the second preferred embodiment may also be applied to the structure of the first preferred embodiment, where compensation of the pixel circuits 11 is performed in rows.

Furthermore, since the trend is to increase the size of the array module 1 for bigger displays, signal lines (e.g., the data lines ($V_{DATA}$_1 to $V_{DATA}$_N), lines for transferring the supply voltage (VDD), etc.) increase in length as well, resulting in differences among the voltages received by the pixel circuits 11. Therefore, the present invention provides a third preferred embodiment, where the array unit 1 is divided into four regions for performing compensation/detection.

With reference to FIG. 12 and FIG. 4, the third preferred embodiment is similar to the first preferred embodiment in structure and operation, except that in the third preferred embodiment, during each temporal cycle when the judging device 5 operates in the second detection mode, the scan line ($V_{SCAN}$_n) and a subset of the data lines ($V_{DATA}$_1 to $V_{DATA}$_N) (as opposed to all of the data lines ($V_{DATA}$_1 to $V_{DATA}$_N)) are driven such that the pixel circuits 11 (in one of regions A, B, C and D) on the junctions of the scan line ($V_{SCAN}$_n) and the subset of the data lines ($V_{DATA}$_1 to $V_{DATA}$_N) are activated, and generate the driving current that drives the light-emitting members 120 thereof to emit light. Accordingly, the positioning signal indicates the position of the activated subset of the pixel circuits 11.

With reference to FIG. 13A and FIG. 13B, during a first period that the second transistors 582 of the third circuit members 580 (shown in FIG. 4) of the top half of the judging devices 51 are turned on by the scan signal ($V_{scan}$_EX1), the pixel circuits 11 in the region A are detected, and during a second period that the second transistors 582 of the third circuit members 580 of the top half of the judging devices 51 are turned on by the scan signal ($V_{scan}$_EX1), the pixel circuits 11 in the region B are detected. Similarly, during a first period that the second transistors 582 of the third circuit members 580 (shown in FIG. 4) of the bottom half of the judging devices 51 are turned on by the scan signal ($V_{scan}$_EX1), the pixel circuits 11 in the region C are detected, and during a second period that the second transistors 582 of the third circuit members 580 of the bottom half of the judging devices 51 are turned on by the scan signal ($V_{scan}$_EX1), the pixel circuits 11 in the region D are detected.

It should be noted herein that a similar design may also apply to the second preferred embodiment. In addition, the present invention is not limited to the number of regions divided. The time it takes for detecting variations occurring in all pixel circuits 11 increases as the number of regions divided increases, but accuracy in detection also increases as well.

From the above description, unlike the conventional display, an aperture ratio of the display of this invention is increased and brightness levels of the OLEDs 120 of the pixel circuits 11 of the display of this invention are improved with the sole addition of the compensation circuit 5, 5'.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A display comprising:

a scan line;

a plurality of data lines forming junctions with said scan line;

a plurality of pixel circuits, each of which is disposed at a corresponding one of the junctions of said scan line and said data lines and includes a light-emitting member, wherein when said scan line and one of said data lines are driven, said pixel circuit on the junction of said scan line and said one of said data lines is activated, and generates a driving current that drives said light-emitting member thereof to emit light;

a compensation circuit coupled to said pixel circuits, and operable so as to generate a comparing signal and a positioning signal based on the driving current generated by an activated one of said pixel circuits, the positioning signal indicating a position of said activated one of said pixel circuits;

a voltage controller coupled to said compensation circuit, and operable so as to generate a reference voltage that corresponds to the positioning signal with reference to the comparing signal generated by said compensation circuit; and a data line driver coupled to said data lines and said voltage controller, adapted to receive an image signal, and operable so as to correct the image signal received thereby based on the reference voltage generated by said voltage controller, and so .as to drive said data lines with the image signal corrected thereby;

wherein said compensation circuit includes a transistor unit coupled to said pixel circuits and said voltage controller, and a comparator coupled to said transistor unit and adapted to receive a reference current, said comparator receiving the driving current generated by said activated one of said pixel circuits when said transistor unit is turned on, and comparing the driving current received thereby to the reference current received thereby so as to generate the comparing signal, the comparing signal generated by said compensation circuit being a high level signal when it is determined by said comparator that the driving current is less than the reference current;

wherein the display is operable in a first detection mode, where said data line driver is operable to drive one of said data lines that corresponds to said activated one of said pixel circuits with a predetermined test signal, and to correct the predetermined test signal in steps according to a predetermined adjustment signal until the reference voltage from said voltage controller indicates transition of the comparing signal from the high level signal to a low level signal; and wherein said voltage controller generates the reference voltage based on the predetermined adjustment signal and a number of steps taken to correct the predetermined test signal.

2. The display as claimed in claim 1, further comprising a storage unit coupled between said compensation circuit and said voltage controller for keeping track of a number of times that the comparing signal is the high level signal prior to becoming the low level signal.

3. The display as claimed in claim 1, wherein said transistor unit includes a first transistor that is coupled to said pixel circuits and said voltage controller and that is responsive to a control signal, and a second transistor that is coupled to said first transistor, and that is responsive to a scan signal.

4. The display as claimed in claim 1, wherein said compensation circuit further includes a transistor coupled to said pixel circuits, and an electrical ground coupled to said transistor, wherein the display is further operable in a normal operation mode, where the driving current generated by said activated one of said pixel circuits is grounded by said compensation circuit when said transistor of said compensation circuit is turned on.

5. The display as claimed in claim 1, further comprising a scan line driver coupled to said scan line, and operable so as to drive said scan line.

6. The display as claimed in claim 1, wherein, during each temporal cycle, said scan line and a subset of said data lines are driven such that said pixel circuits on the junctions of said scan line and said subset of said data lines are activated, and generate the driving current that drives said light-emitting members thereof to emit light, the positioning signal indicating the position of said activated subset of said pixel circuits.

7. A display comprising:

a plurality of scan lines;

a plurality of data lines forming junctions with each of said scan lines;

a plurality of pixel circuits, each of which is disposed at a corresponding one of the junctions of said scan lines and said data lines, and includes a light-emitting member, wherein when said data lines and one of said scan lines are driven, a set of said pixel circuits on the junctions of said data lines and said one of said scan lines is activated, and generates a driving current that drives said light-emitting members thereof to emit light;

a compensation circuit coupled to said pixel circuits, and operable so as to generate a comparing signal and a positioning signal based on the driving current generated by an activated set of said pixel circuits, the positioning signal indicating a position of said one of said scan lines;

a voltage controller coupled to said compensation circuit, and operable so as to generate a reference voltage that corresponds to the positioning signal with reference to the comparing signal generated by said compensation circuit; and a data line driver coupled to said data lines and said voltage controller, adapted to receive an image signal, and operable so as to correct the image signal received thereby based on the reference voltage generated by said voltage controller, and so as to drive said data lines with the image signal corrected thereby;

wherein said compensation circuit includes a plurality of judging devices corresponding in number to said scan lines, each of said judging devices including a transistor unit coupled to said voltage controller and a corresponding set of said pixel circuits that are disposed at the junctions of said data lines and a corresponding one of said scan lines, and a comparator coupled to said transistor unit and adapted to receive a reference current, said comparator receiving the driving current generated by the corresponding set of said pixel circuits when said transistor unit is turned on, and comparing the driving current received thereby to the reference current received thereby so as to generate the comparing signal, the comparing signal being a high level signal when it is determined by said comparator that the driving current is less than the reference current;

wherein the display is operable in a second detection mode, where said data line driver is operable to drive each of said data lines with a predetermined test signal, and to correct the predetermined test signal in steps according to a predetermined adjustment signal until the reference voltage from said voltage controller indicates transition of the comparing signal from the high level signal to a low level signal, and wherein said voltage controller generates the reference voltage based on the predetermined adjustment signal and a number of steps taken to correct the predetermined test signal.

8. A display comprising:

a plurality of scan lines;

a plurality of data lines forming junctions with each of said scan lines;

a plurality of pixel circuits, each of which is disposed at a corresponding one of the junctions of said scan lines and said data lines, and includes a light-emitting member, wherein when one of said scan lines and one of said data lines are driven, one of said pixel circuits on the junctions of said one of said scan lines and said one of said data lines is activated, and generates a driving current that drives said light-emitting member thereof to emit light;

a compensation circuit coupled to said pixel circuits, and operable so as to generate a degradation parameter and a positioning signal based on the driving current generated by an activated one of said pixel circuits, the positioning signal indicating a position of said activated one of said pixel circuits;

a voltage controller coupled to said compensation circuit, and operable so as to generate a reference voltage that corresponds to the positioning signal with reference to the degradation parameter generated by said compensation circuit; and a data line driver coupled to said data lines and said voltage controller, adapted to receive an image signal, and operable so as to correct the image signal received thereby based on the reference voltage generated by said voltage controller, and so as to drive said data lines with the image signal corrected thereby;

wherein said compensation circuit includes a plurality of judging devices corresponding in number to said data lines, each of said judging devices including a time determining unit coupled to a corresponding set of said pixel circuits that are disposed at the junctions of said scan lines and a corresponding one of said data lines, and determining a time it takes for the driving current generated by an activated one of said pixel circuits in the corresponding set to reach a threshold value after said activated one of said pixel circuits is driven by a predetermined test signal that increases according to a predetermined rule, and a degradation parameter determining unit coupled to said time determining unit for generating the degradation parameter with reference to the predetermined test signal and the time determined by said time determining unit, the degradation parameter indicating a level of degradation of said activated one of said pixel circuits and serving as a basis for generation of the reference voltage by said voltage controller.

9. The display as claimed in claim 8, wherein the predetermined test signal increases by fixed steps in fixed intervals of time.

10. A compensation circuit for a display that includes at least one set of pixel circuits, each pixel circuit in each set receiving a respective data voltage, and generating a driving current that corresponds to the respective data voltage received thereby, said compensation circuit comprising:

at least one judging device that includes a time determining unit adapted to be coupled to a corresponding set of pixel circuits, and determining a time it takes for the driving current generated by an activated pixel circuit in the corresponding set to reach a threshold value after the activated pixel circuit is driven by a predetermined test signal that increases according to a predetermined rule, and a degradation parameter determining unit coupled to said time determining unit for generating a degradation parameter with reference to the predetermined test signal and the time determined by said time determining unit, the degradation parameter indicating a level of degradation of the activated pixel circuit in the corresponding set and serving as a basis for adjusting the respective data voltage corresponding to the activated pixel circuit.

* * * * *